US009468858B2

(12) United States Patent
Cai

(10) Patent No.: US 9,468,858 B2
(45) Date of Patent: Oct. 18, 2016

(54) TRANSFORMABLE YO-YO

(71) Applicants: Guangdong Alpha Animation & Culture Co., Ltd., Shantou (CN); Guangdong Auldey Animation & Toy Co., Ltd., Guangzhou (CN); Guangzhou Alpha Culture Communications Co., Ltd., Guangzhou (CN)

(72) Inventor: Dongqing Cai, Shantou (CN)

(73) Assignees: Guangdong Alpha Animation & Culture Co., Ltd. (CN); Guangdong Auldey Animation & Toy Co., Ltd. (CN); Guangzhou Alpha Culture Communications Co., Ltd. (CN)

( * ) Notice: Subject to any disclaimer, the term of this patent is extended or adjusted under 35 U.S.C. 154(b) by 0 days.

(21) Appl. No.: 14/763,398

(22) PCT Filed: Jan. 17, 2015

(86) PCT No.: PCT/CN2015/070946

§ 371 (c)(1),
(2) Date: Jul. 24, 2015

(87) PCT Pub. No.: WO2016/015459

PCT Pub. Date: Feb. 4, 2016

(65) Prior Publication Data

US 2016/0175722 A1 Jun. 23, 2016

(30) Foreign Application Priority Data

Jul. 30, 2014 (CN) ..... 2014 1 0368759

(51) Int. Cl.
*A63H 1/30* (2006.01)
*A63H 1/00* (2006.01)

(52) U.S. Cl.
CPC ..... *A63H 1/30* (2013.01)

(58) Field of Classification Search
CPC ..... A63H 1/00; A63H 1/30
USPC ..... 446/250–251
See application file for complete search history.

(56) References Cited

U.S. PATENT DOCUMENTS

2010/0317255 A1* 12/2010 Van Dan Elzen ..... A63H 1/30 446/250
2013/0109269 A1* 5/2013 Hasegawa ..... A63H 1/30 446/250
2014/0154945 A1 6/2014 Labarbara et al.

FOREIGN PATENT DOCUMENTS

CN 201088836 Y 7/2008
CN 202762076 U 3/2013
CN 203303633 U 11/2013
CN 203724754 U 7/2014
CN 204121739 U 1/2015

OTHER PUBLICATIONS

International Search Report for Application No. PCT/CN2015/070946 dated Apr. 24, 2015.

*Primary Examiner* — Kien Nguyen
(74) *Attorney, Agent, or Firm* — Lerner, David, Littenberg, Krumholz & Mentlik, LLP

* cited by examiner

(57) ABSTRACT

A transformable yo-yo includes two rotators and a connecting shaft. A through hole, into which the connecting shaft is inserted from two directions, is provided in the middle of each of the rotators. A connecting device, configured to connect and secure the connecting shaft, is provided in the through hole. By moving the connecting device, the connecting shaft can be released so that the rotators are separated from the connecting shaft. Back sides of the two rotators are oppositely connected to the connecting shaft, and connected and secured through the connecting device to assemble a yo-yo of a first form. After release, the front sides of the two rotators are oppositely connected to the connecting shaft, and secured through the connecting device as well to assemble a yo-yo of a second form.

11 Claims, 7 Drawing Sheets

TRANSFORMABLE YO-YO

CROSS-REFERENCE TO RELATED APPLICATIONS

The present application is a national phase entry under 35 U.S.C §371 of International Application No. PCT/CN2015/070946 filed Jan. 17, 2015, which claims priority from Chinese Application No. 201410368759.5 filed Jul. 30, 2014, all of which are hereby incorporated herein by reference.

TECHNICAL FIELD

The present invention relates to a yo-yo, in particular to a transformable yo-yo.

BACKGROUND OF THE PRESENT INVENTION

At present, commercially available yo-yos mainly consist of the following components: as the basic composition, two rotators and a connecting shaft for connecting the two rotators; a screw hole is formed in the middle of a back side of each of the rotators, threads are provided on two ends of the connecting shaft; and the screw hole and the threads work together to assemble a complete yo-yo. Such a yo-yo can only be assembled in one way, that is, such a yo-yo has only one form with no alterability, and is thus less fun. As a result, kids are more likely to lose interest in such a yo-yo. Should the kids desire a yo-yo of another form, they would have to buy a new one. When they have a new yo-yo, the older one will likely be discarded, which is a waste of resources.

SUMMARY OF THE PRESENT INVENTION

An objective of the present invention is to provide a transformable yo-yo, capable of being mounted from both front and back sides and having two forms and persistent interestingness, to solve the above existing problem.

A technical solution of the present invention is realized as follows:

a transformable yo-yo is provided, including two rotators and a connecting shaft for connecting the two rotators, characterized in that a though hole, into which the connecting shaft is inserted from two directions, is provided in the middle of each of the rotators, and a connecting device, configured to connect and secure the connecting shaft, is provided in the through hole; by moving the connecting device, the securing to the connecting shaft can be released so that the rotators are separated from the connecting shaft; the back sides of the two rotators are oppositely connected to the connecting shaft, and connected and secured through the connecting device to assemble a yo-yo of a first form; and after releasing the securing, the front sides of the two rotators are oppositely connected to the connecting shaft, and secured through the connecting device as well to assemble a yo-yo of a second form.

The connecting device of the present invention may be a clamping structure or a screwing structure, wherein the screwing structure includes internal threads provided on the through hole and external threads provided at two ends of the connecting shaft, the internal threads and the external threads work together to connect and secure the connecting shaft to the rotators.

The clamping structure of the present invention includes clamping sites provided at the two ends of the connecting shaft and clamping members provided in the rotators, and after inserting the connecting shaft into the through hole from the front side of each of the rotators or from the back side of each of the rotators, the clamping sites on the connecting shaft are clamped and secured with the clamping members in the rotators, automatically.

In order to release the securing easily, the clamping members in the rotators are elastic clamping members, and by pressing the elastic clamping members to release the clamping between the elastic clamping members and the clamping sites of the connecting shaft, the rotators are separated from the connecting shaft.

In order to enable the connecting shaft to secure and connect to the rotators and enable a yo-yo to rotate by itself at an end of a string, the connecting shaft includes a post having threads at both ends thereof, a bearing sleeved in the middle of the post, and two bushings screwed on the threads at the both ends of the post; and the clamping sites are formed at the front end of the bushing.

The clamping sites of the present invention are annular groove sites or pin holes formed on the bushings, and correspondingly, the clamping members are clamping plates clamped into the annular grooves or plug pins inserted into the pin holes.

To achieve easy mounting and connecting, each of the rotators includes a disk and a shell, and the disk is butt-jointed to the shell and then connected and secured after being screwed by screws; each of the clamping members is arranged in the disk; and each of the bushing of the connecting shaft extends into the disk and the clamping sites on the bushing are clamped with the clamping members.

Further, a through hole, from which the bushing is extended, is arranged in the middle of each of the disk and the shell; the bushing is inserted into the through hole on the disk to be connected to the clamping member to assemble the yo-yo of the first form; and the bushing is inserted into the through hole on the shell to be connected to the clamping member to assemble the yo-yo of the second form.

In order to ensure that the rotators can rotate along with the connecting shaft, synchronously, and hexagonal hole seats are provided on inner sides of the through holes on both the disk and the shell, and correspondingly, rear ends of the bushings are designed as hexagonal columns; and the hexagonal columns and the hexagonal hole seats work together to enable the rotators to rotate along with the connecting shaft, synchronously.

Each of the elastic clamping members of the present invention includes a pair of Γ-shaped clamping plates and a compression spring provided at a front end of a front crossbar of the clamping plate, and correspondingly, the clamping sites on the connecting shaft are designed as circular grooves; the two clamping plates work together to press a front end of the compression spring of one clamping plate onto a front edge of a rear crossbar of the other clamping plate; and after the two clamping plates are mounted into the rotators, due to compression by the compression springs, rear edges of the front crossbars of the two clamping plates are clamped into the circular grooves of the connecting shaft, thus realizing the purpose of fastening and securing.

To achieve easy operation and control, two symmetrical through openings are formed on side walls of the rotators; the two clamping plates are mounted in a direction of the through openings, and the rear ends of the rear crossbars of the two clamping plates are both extended from the through openings of the rotators to form two pressing ends; pressing the two pressing ends by fingers so that the rear edges of the front crossbars of the clamping plates move to be relatively separated from each other, the clamping plates release the clamping to the circular groove, thus realizing the separation of the rotators from the connecting shaft.

As a though hole, into which the connecting shaft is inserted from two directions, is provided in the middle of each of the rotators, and a connecting device, configured to connect and secure the connecting shaft, is provided in the through hole, by moving the connecting device, the securing to the connecting shaft can be released so that the rotators are separated from the connecting shaft; the back sides of the two rotators are oppositely connected to the connecting shaft, and connected and secured through the connecting device to assemble a yo-yo of a first form; and after releasing the securing, the front sides of the two rotators are oppositely connected to the connecting shaft, and secured through the connecting device as well to assemble a yo-yo of a second form. Therefore, a yo-yo of the present invention has two different assembling forms, kids can transform a yo-yo to a different form according to their preferences, and the yo-yo in a different form also has different characteristics. As the characteristics are different, different tricky moves are possible. Kids may play with a yo-yo in more varied ways and have more fun. The transformable yo-yo of the present invention, which is an equivalence to two existing yo-yos, is more cost effective and can gain traction more easily among with kids. Furthermore, as the elastic clamping members are used as the connecting device, the transforming operation is simpler, easier, and faster, without getting in the way of the kids playing. Furthermore, such a connecting method contributes to low wear rate and thus effectively improves the service life of the yo-yo. This toy yo-yo is smartly designed, can offer variable assembly forms and novel ways to play, meets the needs and the curiosity of kids, and meanwhile riches ways of playing with the yo-yo, so that this yo-yo is very interesting.

BRIEF DESCRIPTION OF THE DRAWINGS

The present invention will be further described as below with reference to the accompanying drawings.

DETAILED DESCRIPTION OF THE PRESENT INVENTION

As shown in FIG. 1 to FIG. 7, a transformable yo-yo is provided, including two rotators 1 and a connecting shaft 2 for connecting the two rotators 1, wherein a though hole 10, into which the connecting shaft 2 is inserted form two directions, is arranged in the middle of each of the rotators 1, and a connecting device, configured to connect and secure the connecting shaft 2, is arranged in the through hole 10; by moving the connecting device, the securing to the connecting shaft 2 can be released so that the rotators 1 are separated from the connecting shaft 2; the back sides of the two rotators 1 are oppositely connected to the connecting shaft 2, and connected and secured through the connecting device to assemble a yo-yo of a first form; and after releasing the securing, the front sides of the two rotators 1 are oppositely connected to the connecting shaft 2, and secured through the connecting device as well to assemble a yo-yo of a second form. Hence, a yo-yo has two different assembling forms, kids can transform a yo-yo to a different form according to their preferences, and the yo-yo in a different form also has different characteristics. According to different characteristics, corresponding fancy operations may be made. Kids may play with a yo-yo in more varied ways and become more interested. The transformable yo-yo of the present invention, equivalently to two existing yo-yos, is cost effective and more easily to be popular with kids.

Embodiment 1

Figure 6:
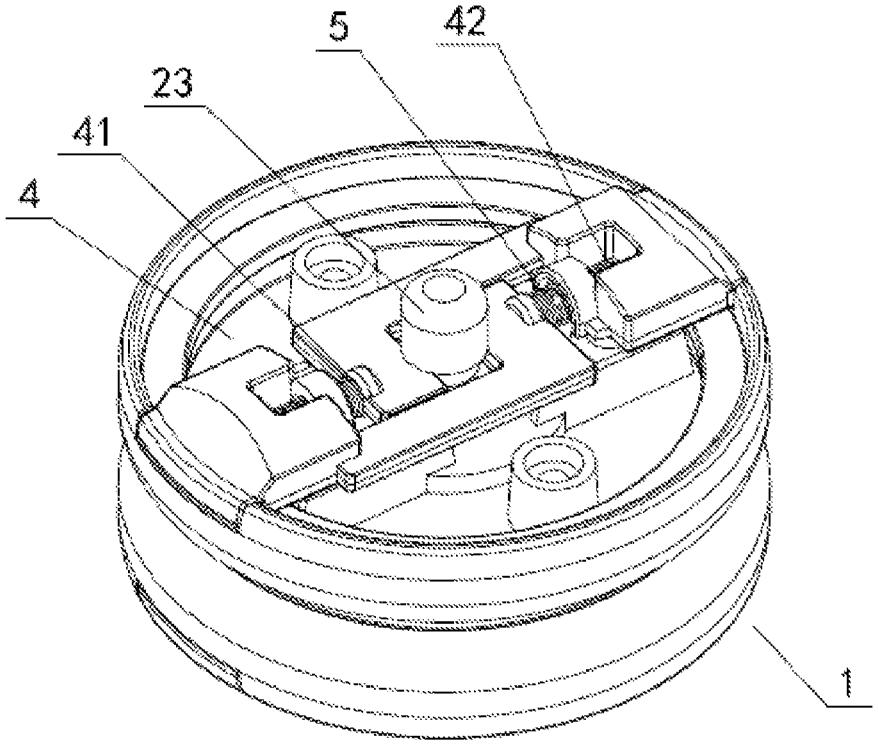
FIG. 6 is an internally structural diagram of elastic clamping embers, in a clamped state, of the present invention.
Figure 7:
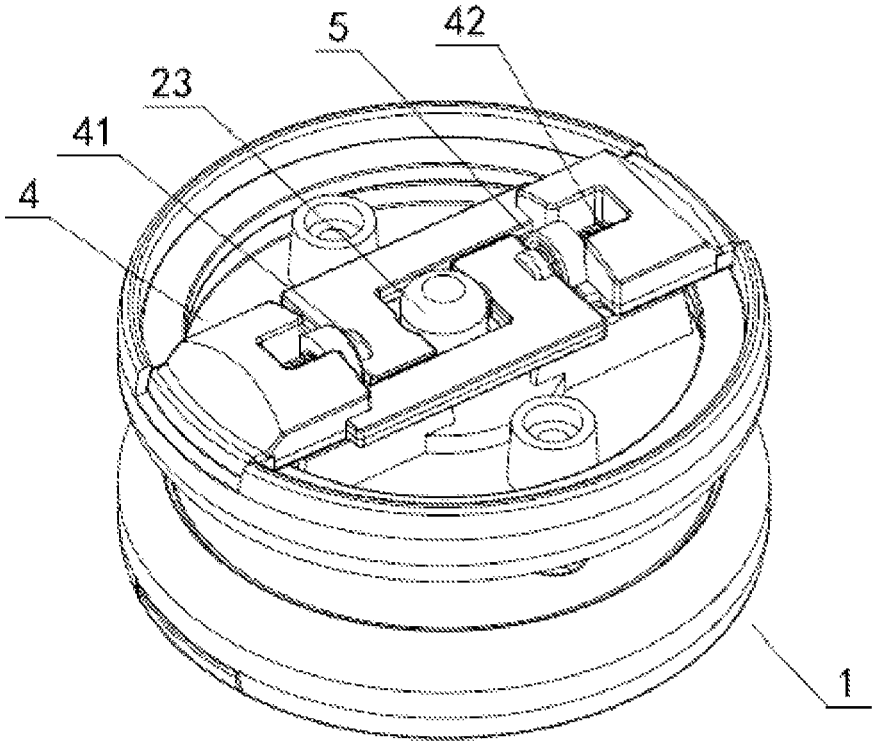
FIG. 7 is an internally structural diagram of elastic clamping embers, in an unclamped state, of the present invention.

The connecting device of this embodiment is a clamping structure which includes clamping sites arranged at the two ends of the connecting shaft 2 and elastic clamping members arranged in the rotators 1, and after inserting the connecting shaft 2 into the through hole 10 from the front side of each of the rotators 1 or from the back side of each of the rotators 1, the clamping sites on the connecting shaft 2 are clamped and secured with the clamping members in the rotators 1, automatically, as shown in FIG. 6; and by pressing the elastic clamping members to release the clamping between the elastic clamping members and the clamping sites of the connecting shaft 2, the rotators 1 are separated from the connecting shaft 2, as shown in FIG. 7.

Figure 1:
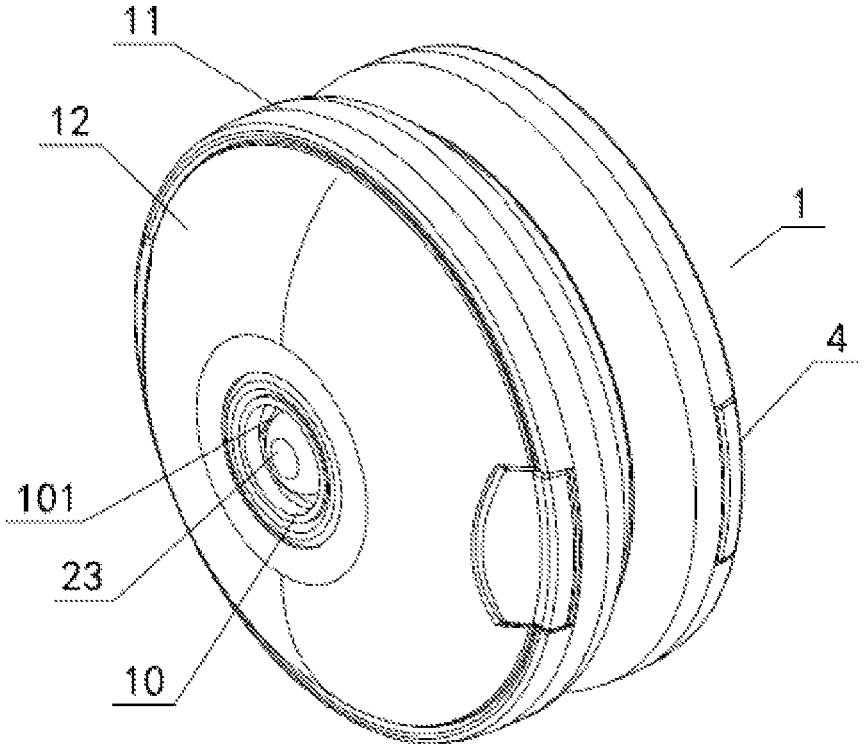
FIG. 1 is a 3D structural diagram of a first form of the present invention.
Figure 2:
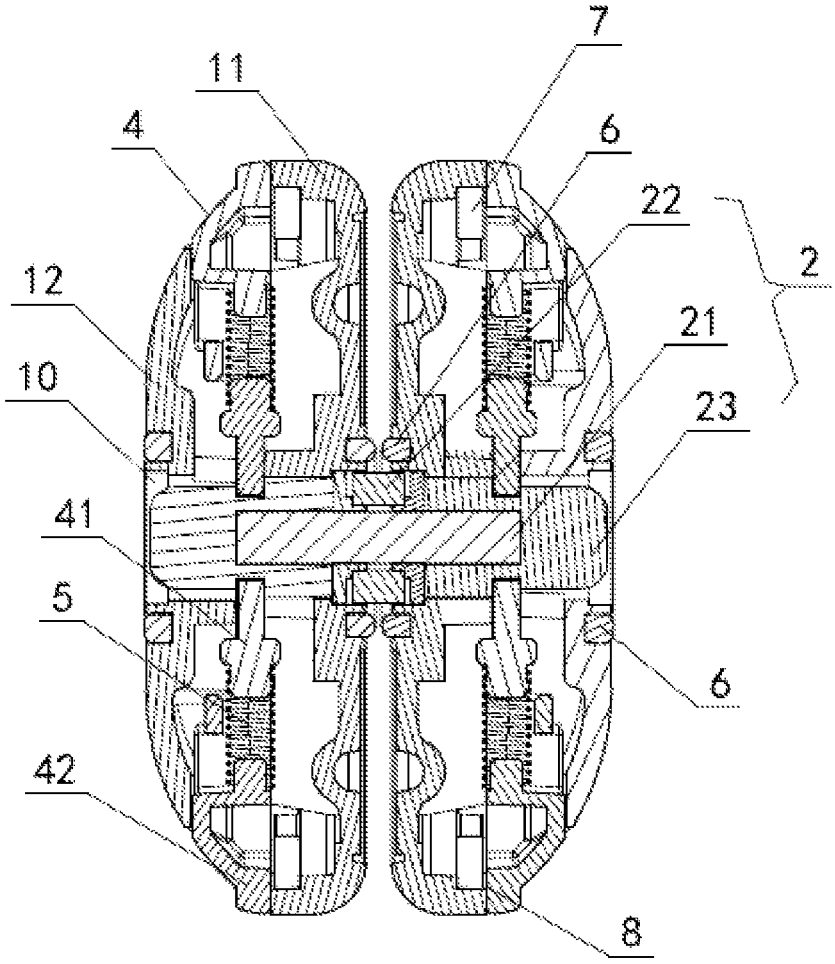
FIG. 2 is a structural diagram of the first form of the present invention in a cross-sectional view.
Figure 3:
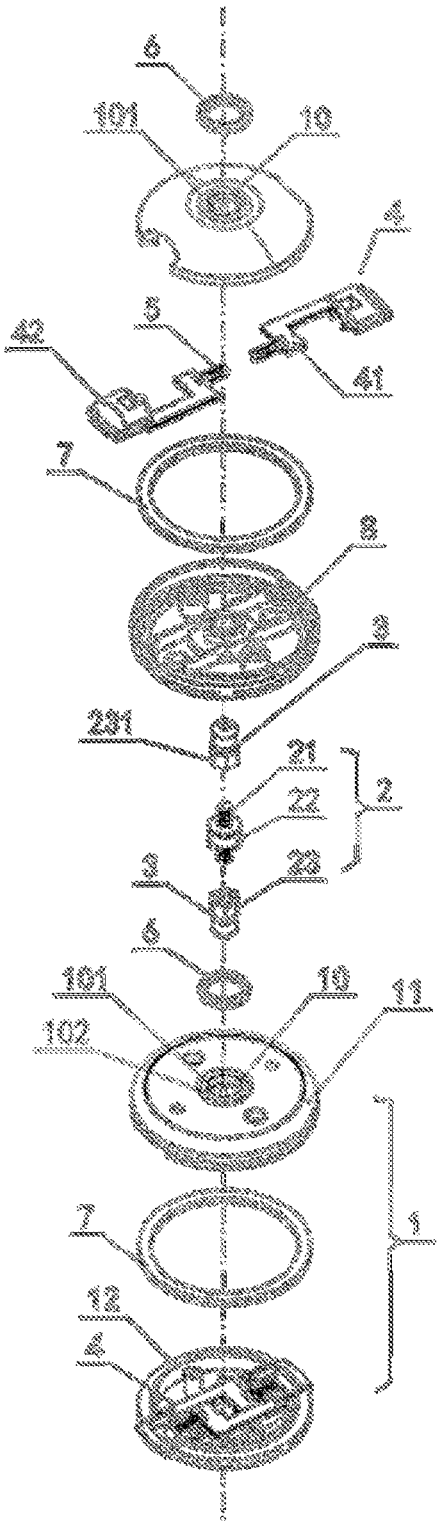
FIG. 3 is an assembling/disassembling structural diagram of the first form of the present invention.
Figure 4:
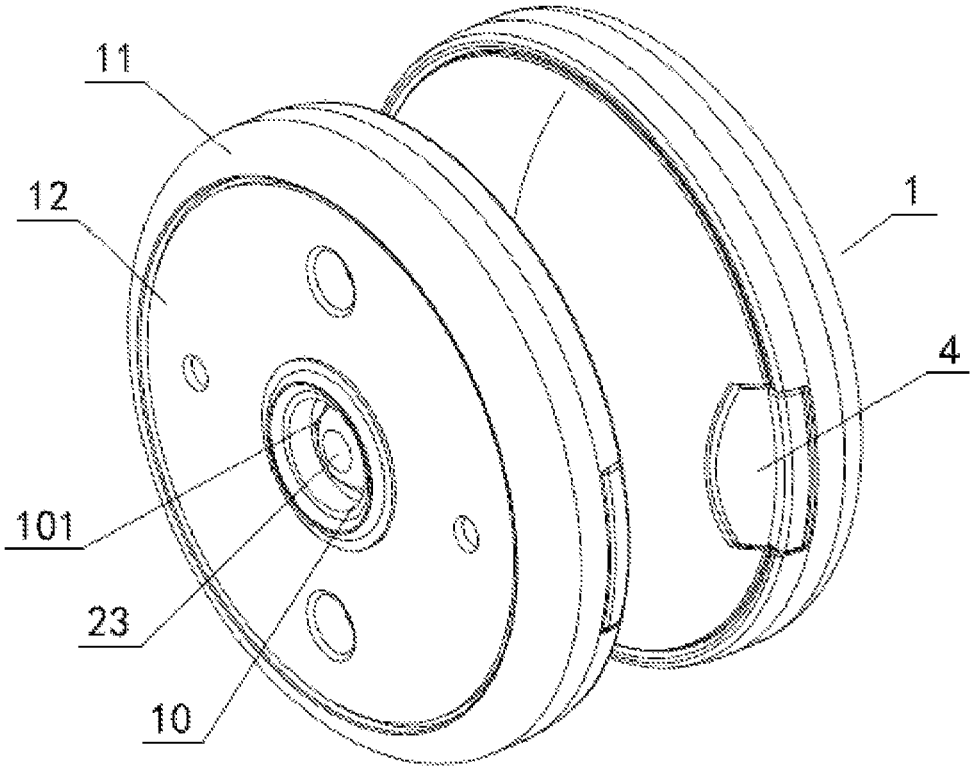
FIG. 4 is a 3D structural diagram of a second form of the present invention.
Figure 5:
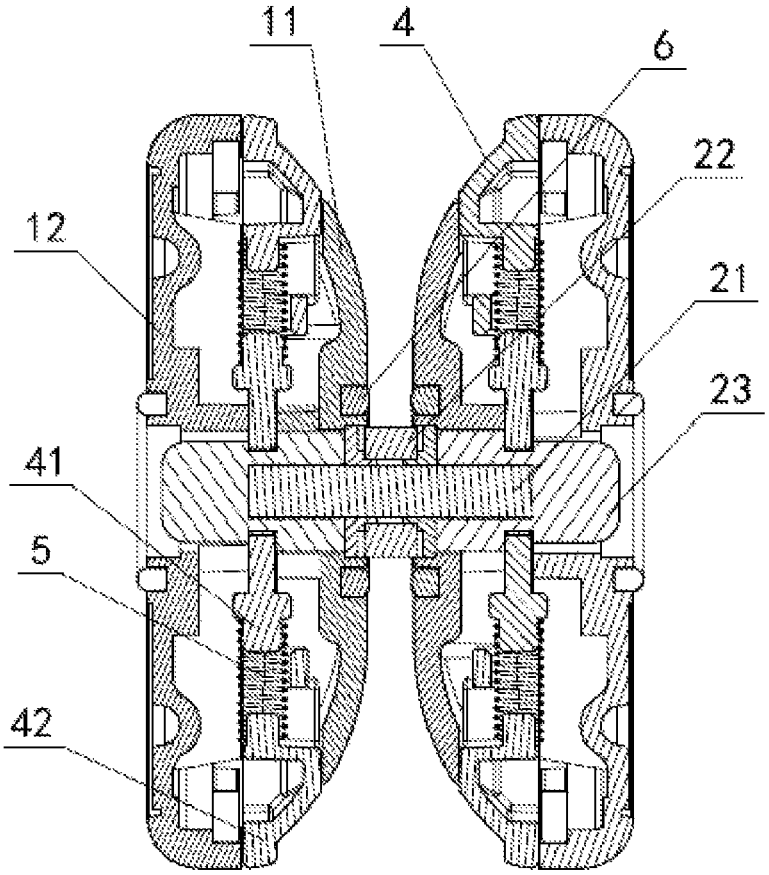
FIG. 5 is a structural diagram of the second form of the present invention in a cross-sectional view.

As shown in FIG. 2, FIG. 3 and FIG. 5, the connecting shaft 2 of this embodiment includes a post 21 having threads at both ends thereof, a bearing 22 sleeved in the middle of the post 21, and two bushings 23 screwed on the threads at the both ends of the post 21; the clamping sites are formed at the front end of the bushing 23. Each of the rotators 1 of this embodiment includes a disk 11 and a shell 12, and the disk 11 is butt-jointed to the shell 12 and then connected and secured when screwed by screws; each of the elastic clamping members is arranged in the disk 11; a through hole 10, from which the bushing 23 is extended, is arranged in the middle of each of the disk 11 and the shell 12, the bushing 23 is inserted into the through hole 10 on the disk 11 to be connected to the clamping member to assemble the yo-yo of the first form, and the bushing 23 is inserted into the through hole 10 on the shell 12 to be connected to the clamping member to assemble the yo-yo of the second form. In order to ensure that the rotators 1 can synchronously rotate along with the post 21 of the connecting shaft 2, and hexagonal hole seats 101 are arranged on inner sides of the through holes 10 on both the disk 11 and the shell 12, and correspondingly, rear ends of the bushings 23 are designed as hexagonal columns 231; and the hexagonal columns 231 and the hexagonal hole seats 101 work together to enable the rotators 1 to rotate along with the connecting shaft 2, synchronously. Each of the elastic clamping members of this embodiment includes a pair of U-shaped clamping plates 4 and a compression spring 5 arranged at a front end of a front crossbar 41 of the clamping plate 4, and correspondingly, the clamping sites on the connecting shaft 2 are designed as circular grooves 3; the two clamping plates 4 work together to press a front end of the compression spring 5 of one clamping plate 4 onto a front edge of a rear crossbar 42 of the other clamping plate 4; hence, after the two clamping plates 4 are mounted into the disk 11 of the rotators 1, due to compression by the compression springs 5, rear edges of the front crossbars 41 of the two clamping plates 4 are clamped into the circular grooves 3 of the connecting shaft 2, thus realizing the purpose of fastening and securing, as shown in FIG. 6. Two symmetrical through openings 8 are formed on side walls of both the disk 11 and the shell 12 of this embodiment, meanwhile, a mounting guide plate is provided in interior of the disk 11; the two clamping plates 4 are mounted in a direction of the through openings 8, and the rear ends of the rear crossbars 42 of the two clamping plates 4 are both extended from the through openings 8 of the rotators 1 to form two pressing ends; pressing the two pressing ends by two fingers so that the rear edges of the front crossbars 41 of the clamping plates 4 move to be relatively separated from each other, as a result, the relative distance between the rear edges of the front crossbars 41 of the clamping plates 4 becomes larger until the rear edges of the two front crossbars 41 extends from the circular 3; and at this moment, the rotators 1 are pulled outward by two fingers, simultaneously, to separate the rotators 1 from the connecting shaft 2; the operation of the other rotator 1 is the same as that mentioned above, as shown in FIG. 7. After the separation, the directions of the rotators 1 are turned back, so that the through hole 10 of the shell 12 is aligned with the connecting shaft 2 and the connecting shaft 2 is inserted into the through hole 10, and by slightly pressing the connecting shaft 2 inward to clamp the circular groove 3 of the connecting shaft 2 with the elastic clamping member; there will be a clicking sound during the clamping; and it is very easy to form a yo-yo of the second form. Such a connecting method employing this elastic clamping member enables the transformation operation to be simpler, easier and faster, without influencing the interest of kids to play with the yo-yo. Furthermore, such a connecting method contributes to low wear rate and thus effectively improves the service life of the yo-yo. In order to ensure that the string of a yo-yo in the two forms can be withdrawn easily, in this embodiment, circular grooves 102 are concavely arranged in positions, close to the through holes 10, on outer sides of both the disk 11 and the shell 12, and withdrawing rings 6 which facilitate the withdrawing of a string of yo-yo are arranged in the circular grooves 102. In order to further improve the performance of the yo-yo, a balance weight ring 7 may be arranged in each of the rotator 1, and the balance weight ring 7 in this embodiment is mounted in the disk 11 of the rotator 1.

Embodiment 2

The connecting device of this embodiment is also a clamping structure which includes clamping sites arranged at the two ends of the connecting shaft 2 and clamping members arranged in the rotators 1. What is different is that the clamping members in the rotators 1 are not elastic, and after inserting the connecting shaft 2 into the through hole 10 from the front side of each of the rotators 1 or from the back side of each of the rotators 1, the clamping members are pushed inward by a hand to be clamped and secured with the clamping sites of the connecting shaft; and when the clamping is required to be released, the clamping members are required to be pulled outward by a hand so that the clamping members release the clamping to the clamping sites of the connecting shaft 2 thus to separate the rotators 1 from the connecting shaft 2.

Embodiment 3

The connecting device of this embodiment is also a clamping structure. What is different is that the clamping structure includes pin holes formed at both ends of the connecting shaft 2 and plug pins formed on the rotators 1; after inserting the connecting shaft 2 into the through hole 10 from the front side of each of the rotators 1 or from the back side of each of the rotators 1, and after aligning the pin holes with the positions of the plug pins, the plug pins are pushed inward into the pin holes by a hand in order to be clamped and secured therein; and when the clamping is required to be released, the plug pins are required to be pulled by a hand out from the pin holes of the connecting shaft thus to release the clamping. As a result, the rotators 1 separates from the connecting shaft 2.

Embodiment 4

The connecting device of this embodiment is a screwing structure which includes internal threads arranged on the through hole 10 and external threads arranged at two ends of the connecting shaft 2, and the external threads of the connecting shaft 2 are inserted into the internal threads of the through hole 10 from the front side of each of the rotators 1 or from the back side of each of the rotators 1 so that the connecting shaft 2 connects and clamps to the rotators 1; and when the clamping is required to be released, directly rotating the rotators 1 may separate the rotators 1 from the connecting shaft 2.

Although the present invention has been described with reference to specific embodiments, such description is not intended to limit the present invention. Referring to the description of the present invention, other variations of the disclosed embodiments can be predicted by those skilled in the art, and such variations should fall into the scope defined by the claims.

The invention claimed is:

1. A transformable yo-yo comprising: two rotators, a connecting device and a connecting shaft for connecting together the two rotators each having a back side and a front side, wherein a through hole, into which the connecting shaft is inserted from two directions is provided in the middle of each of the rotators, and the connecting device configured to connect and secure the connecting shaft to the rotators is provided in the through hole; wherein upon moving the connecting device, the connecting shaft is released from the rotators so that the rotators are separated from the connecting shaft; wherein the back sides of the two rotators can be oppositely connected to the connecting shaft through the connecting device to assemble the yo-yo of a first form; and alternatively wherein the front sides of the two rotators can be oppositely connected to the connecting shaft through the connecting device to assemble the yo-yo of a second form; wherein the connecting device comprises a clamping structure or a screwing structure, the screwing structure comprises internal threads provided on the through hole and external threads provided at two ends of the connecting shaft, the internal threads and the external threads working together to connect and secure the connecting shaft to the rotators; and wherein the clamping structure comprises clamping sites provided on the two ends of the connecting shaft and clamping members provided in the rotators, and wherein after inserting the connecting shaft into the through hole from the front side of each of the rotators or from the back side of each of the rotators, the clamping sites on the connecting shaft are automatically clamped and secured with the clamping members in the rotators.

2. The transformable yo-yo according to claim 1, wherein the clamping members in the rotators are elastic clamping members, and wherein by pressing the elastic clamping members to release the clamping between the elastic clamping members and the clamping sites of the connecting shaft, the rotators are separated from the connecting shaft.

3. The transformable yo-yo according to claim 1, wherein the connecting shaft comprises a post having threads at both ends of the post, a bearing sleeved in the middle of the post, and two bushings screwed on the threads at both ends of the post; and the clamping sites are formed at the front end of the bushings.

4. The transformable yo-yo according to claim 3, wherein the clamping sites are annular groove sites or pin holes formed on the bushings, and the clamping members are clamping plates clamped into the annular grooves or plug pins inserted into the pin holes.

5. The transformable yo-yo according to claim 3, wherein each of the rotators comprises a disk and a shell; the disk butt-jointed to the shell and connected and secured by screws; each of the clamping members arranged in the disk; and each of the bushings of the connecting shaft extend into the disk wherein the clamping sites on the bushings are clamped with the clamping members.

6. The transformable yo-yo according to claim 5, wherein a through hole, is arranged in the middle of each disk and shell; the bushing inserted into the through hole on the disk to be connected to the clamping member to assemble the yo-yo of the first form; and the bushing inserted into the through hole on the shell to be connected to the clamping member to assemble the yo-yo of the second form.

7. The transformable yo-yo according to claim 6, wherein hexagonal hole seats are provided on inner sides of the through holes on both the disk and the shell, and rear ends of the bushings are hexagonal columns; and the hexagonal columns and the hexagonal hole seats synchronously work together to enable the rotators to rotate along with the connecting shaft.

8. The transformable yo-yo according to claim 6, wherein circular grooves are concavely provided in positions close to the through holes, on outer sides of both the disk and the shell, and withdrawing rings which facilitate the withdrawing of a string of a yo-yo are provided in the circular grooves.

9. The transformable yo-yo according to claim 2, wherein each of the elastic clamping members comprises a pair of ⊏-shaped clamping plates and a compression spring provided at a front end of a front crossbar of the clamping plate, and the clamping sites on the connecting shaft are circular grooves; the two clamping plates work together to press a front end of the compression spring of one clamping plate onto a front edge of a rear crossbar of the other clamping plate; and wherein after the two clamping plates are mounted into the rotators due to compression by the compression springs, rear edges of the front crossbars of the two clamping plates are clamped into the circular grooves of the connecting shaft.

10. The transformable yo-yo according to claim 9, wherein two symmetrical through openings are formed on side walls of the rotators; the two clamping plates are mounted in a direction of the through openings, and rear ends of the rear crossbars of the two clamping plates are both extended from the through openings of the rotators to form two pressing ends; wherein pressing the two pressing ends by fingers so that the rear edges of the front crossbars of the clamping plates move to be relatively separated from each other, the clamping plates release the clamping to the circular groove thereby separating the rotators from the connecting shaft.

11. The transformable yo-yo according to claim 1, wherein a balance weight ring is provided in each rotator.

* * * * *